US007728709B2

(12) United States Patent
Grünbichler et al.

(10) Patent No.: US 7,728,709 B2
(45) Date of Patent: Jun. 1, 2010

(54) ELECTROCERAMIC COMPONENT

(75) Inventors: Hermann Grünbichler, Graz (AT); Martin Schwingenschuh, Graz (AT)

(73) Assignee: EPCOS AG, Munich (DE)

( * ) Notice: Subject to any disclaimer, the term of this patent is extended or adjusted under 35 U.S.C. 154(b) by 346 days.

(21) Appl. No.: 10/485,166

(22) PCT Filed: Jul. 4, 2002

(86) PCT No.: PCT/DE02/02457

§ 371 (c)(1),
(2), (4) Date: Aug. 25, 2004

(87) PCT Pub. No.: WO03/017292

PCT Pub. Date: Feb. 27, 2003

(65) Prior Publication Data

US 2004/0264092 A1 Dec. 30, 2004

(30) Foreign Application Priority Data

Aug. 2, 2001 (DE) ..... 101 37 873

(51) Int. Cl.
*H01H 85/05* (2006.01)
*H01H 85/048* (2006.01)

(52) U.S. Cl. ..... 337/4; 337/5; 361/104

(58) Field of Classification Search ..... 337/1, 337/4, 5, 401; 361/104; 257/665; 327/525
See application file for complete search history.

(56) References Cited

U.S. PATENT DOCUMENTS 4,388,603 A * 6/1983 Hassler et al. ..... 337/158
4,652,964 A 3/1987 Ziegenbein
4,714,910 A 12/1987 Schwingenschuh et al.
5,583,740 A * 12/1996 Fujino ..... 361/534
5,675,468 A * 10/1997 Chang ..... 361/119
5,708,553 A * 1/1998 Hung ..... 361/103
5,713,705 A 2/1998 Grunbichler et al.
5,781,394 A 7/1998 Lorenz et al.
5,982,597 A * 11/1999 Webb ..... 361/103
6,094,128 A * 7/2000 Bennett et al. ..... 338/21
6,252,488 B1 * 6/2001 Ziegler et al. ..... 337/5
6,323,750 B1 11/2001 Schwingenschuh et al.

(Continued)

FOREIGN PATENT DOCUMENTS

DE 33 18 588 11/1984

(Continued)

OTHER PUBLICATIONS

Allgemeine Technische Angaben, p. 30-31.

(Continued)

*Primary Examiner*—Anatoly Vortman
(74) *Attorney, Agent, or Firm*—Fish & Richardson P.C.

(57) ABSTRACT

An electric component includes a first base body that connects to a first contact, and an ally conducting element positioned along a current path between the first contact and a second contact. The electrically conducting element melts when an operating voltage of the electric component is exceeded. The electric component also includes an electrically insulating material that substantially surrounds the electrically conducting element and that is arranged so as to prevent an electric flashover between regions of the current path that are bridged by the electrically conducting element.

12 Claims, 2 Drawing Sheets

U.S. PATENT DOCUMENTS

| | | | | |
|---|---|---|---|---|
| 6,636,403 | B2 * | 10/2003 | McLoughlin et al. | 361/103 |
| 6,636,404 | B1 * | 10/2003 | Whitney et al. | 361/111 |

FOREIGN PATENT DOCUMENTS

| | | |
|---|---|---|
| DE | 36 31 177 | 3/1988 |
| DE | 36 43 622 | 6/1988 |
| DE | 39 27 547 | 2/1991 |
| EP | 1 150 307 | 10/2001 |
| GB | 2 018 535 | 10/1979 |
| JP | 55-12405 | 3/1980 |
| JP | 58-58703 | 4/1983 |
| JP | 58-77201 | 5/1983 |
| JP | 60-148337 | 8/1985 |
| JP | 61-221526 | 10/1986 |
| JP | 62-157040 | 7/1987 |
| JP | 63-050101 | 3/1988 |
| JP | 2-84016 | 3/1990 |
| JP | 02-047 842 | 10/1990 |
| JP | 3-73501 | 3/1991 |
| JP | 4-53106 | 2/1992 |
| JP | 04151804 | 5/1992 |
| JP | 07-182964 | 7/1995 |
| JP | 2000286106 | 10/2000 |

OTHER PUBLICATIONS

English Translation of International Search Report for Application PCT/DE02/02457.

German translation of Office Action from corresponding Japanese Patent Application No. 56-158292, Aug. 31, 2007.

English and German translations of Office Action from corresponding Japanese Patent Application No. 56-158292.

Document English Translation of Office Action in Japanese Application No. 2003-522110 , dated Jul. 25, 2008.

English Translation of Japanese Utility Model Application Disclosure No. 63-50101 (Application No. JP61-144218).

English Translation of Japanese Utility Model Application Disclosure No. 62-157040 (Application No. JP61-45296).

English Translation of Examination Report in corresponding Japanese Application, dated Aug. 11, 2009.

* cited by examiner

ELECTROCERAMIC COMPONENT

TECHNICAL FIELD

This patent application describes an electroceramic component with a temperature fuse.

BACKGROUND

Electroceramic components with a temperature fuse includes varistors, for example The base body of such components is often produced from a mixture of various metal oxides, such as zinc oxide. Varistors have a non-linear voltage-dependent resistance change that is used to protect an electric circuit from overvoltage. The resistance value of a varistor drops as the applied voltage increases.

When an overvoltage appears (e.g., operating voltage that exceeds a permitted limit value for the varistor), current passing through the varistor rises sharply. As a result, the varistor heats-up. A long-lasting overvoltage can lead to overheating and set-off a fire.

A varistor fuse element for protecting an electric circuit from overvoltage and overheating is known from printed document DE 331 85 88. It consists of a mechanical construction in which solder with a low melting point is applied to the varistor, which establishes a spring current conductor. When an overvoltage and associated overheating appears, the solder melts, whereupon the spring structure immediately produces an irreversible low-resistance short circuit with a second current conductor. In this case, the spring structure also increases the distance between the spring current conductor and the varistor, in order to prevent an electric flashover. A disadvantage of this mechanical structure is in the fact that it can be achieved only at great cost.

In printed document JP 04 151 804 A, a temperature fuse is disclosed, that is integrated into a varistor housing, and that is connected through an electric line to an internal electrode of the varistor. The temperature fuse, in this case, is surrounded by a material that permits heat to be conducted between the varistor and the temperature fuse. In case of overheating of the varistor due to long-lasting overvoltage, the heat of the varistor can thereby be transferred to the temperature fuse and trigger it. The disadvantage of this structure is that the temperature fuse is not in direct thermal contact with the varistor. Therefore, because of losses during heat transfer, the fuse is triggered only at higher temperatures.

SUMMARY

This patent application describes an electroceramic component with at least a first ceramic base body. In normal operation, in which the operating voltage does not exceed a predetermined limit value, a current flow occurs between two electrical contacts through the first ceramic base body and an electrically conducting piece. The first ceramic base body contacts the electrically conducting piece and is therefore in direct heat contact with it. When the operating voltage is exceeded, the first ceramic base body heat up strongly due to the increasing loss, so that the electrically conducting body is also heated up. The electroceramic component is implemented in such a way that the electrically conducting piece melts beyond a certain temperature, and current flow is thereby interrupted. An electrically insulating material prevents an electric flashover between the electrically conducting regions contacted by the electrically conducting piece and thus assures a reliable interruption of the current path.

Advantages over the state of the art include that the electrically conducting piece is in direct heat contact with the first ceramic base body. Because of this, no heat transfers associated with losses will occur through enclosing the first surrounding body. The overheating fuse can therefore be triggered at low temperatures at the first base body, and it is therefore significantly more sensitive than traditional fuses. Another advantage is that, after the electrically conducting piece melts, an electric flashover can be prevented in a simple way by the electrically insulating material. No expensive mechanical spring structures are necessary to move the contacts away from each other after the electrically conducting piece melts.

The first base body can contain, for example, a varistor ceramic based on zinc oxide. The electrically conducting piece is advantageously a solder with a low melting point, for example, a melting point between about 80° C. and 180° C. Materials that can drizzle or flow, such as quartz sand or glass balls, can be used as the electrically insulating material.

This has the advantage that the material that can drizzle or flow can penetrate into the liquid metal after the electrically conducting piece, the solder, melts, and thus the formation of an arc light and thereby a flashover can be reliably prevented.

Advantageously, an encapsulation, for example of a heat-resistant plastic such as polyphenylene sulfide (PPS), can be provided that creates a container for the insulating material that can drizzle or flow and thereby simultaneously increase the mechanical stability of the component.

The entire electroceramic component with the integrated temperature fuse and the encapsulation can be surrounded advantageously with a single housing. In this way, a compact component with low space requirement is formed.

In the following, the electroceramic component will be explained in more detail with reference to the diagrams of embodiment examples.

DETAILED DESCRIPTION

Figure 1A:
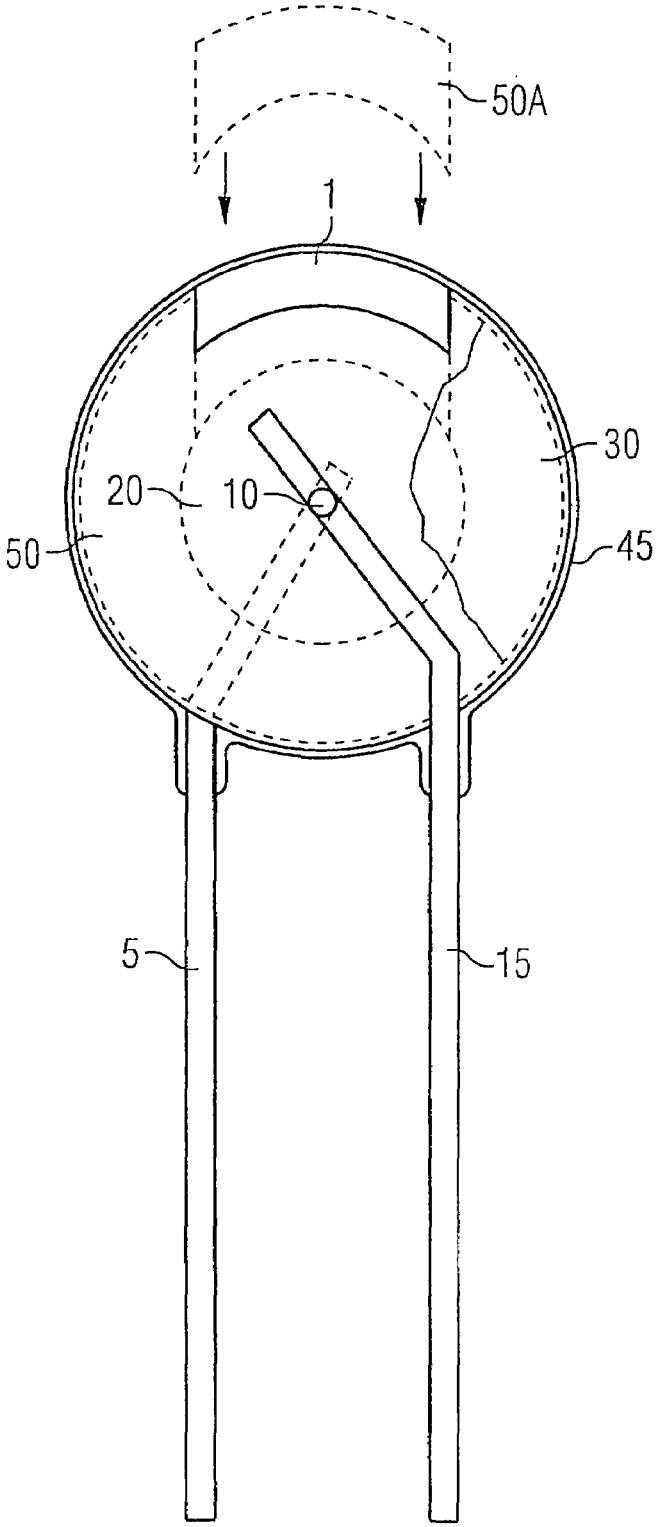
FIGS. 1A and 1B show a varistor with an integrated temperature fuse with two ceramic base bodies, in a top view and in cross-section.
Figure 1B:
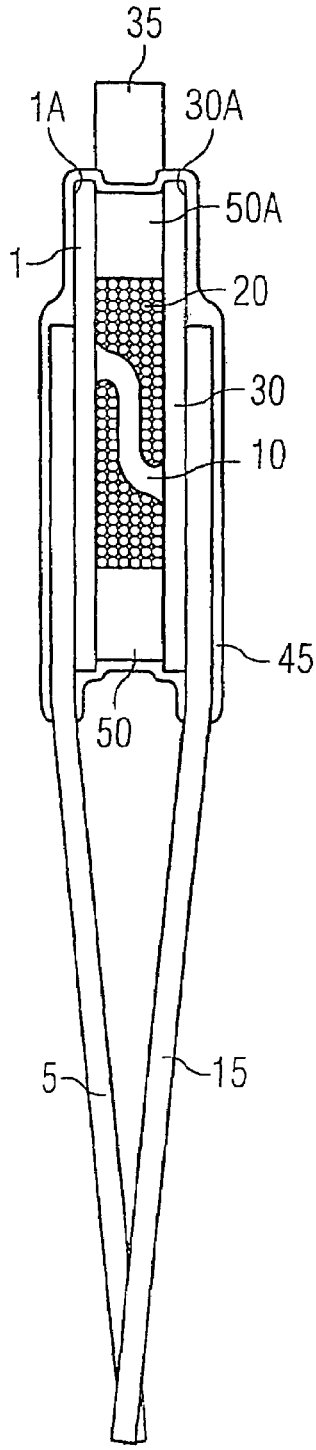

In FIGS. 1A and 1B, a series circuit with two varistor base bodies 1 and 30, each with an operating voltage of about 60 to 75 V, is shown, so that a total operating voltage of about 130 V can be achieved. The two varistor base bodies 1 and 30 are connected to each other in an electrically conducting manner by the electrically conducting piece 10, a low-melting solder with a melting point of about 80° C. to 180° C. The electrically insulating material 20 can be implemented as quartz sand, which is arranged between the two varistor base bodies and surrounds the solder 10. Tinned copper wires, for example, can serve as electric contacts 5 and 15. A plastic ring 50, made of a heat-resistant plastic such as polyphenylene sulfide (PPS), together with the two ceramic base bodies 1 and 30 as a lid, creates a hollow space for the insulating material 20. The hollow space can be closed by a stopper 50A. To prevent external flashovers, the entire component with an integrated temperature fuse can be surrounded advantageously by a housing 45 containing, for example, epoxide plastic.

In case of a strong overvoltage, the electrically conducting piece 10 of the component melts reliably within a few seconds. At the time of the triggering of the temperature fuse, the temperature at the housing of the component is only about 120° C. By this arrangement, it is assured that the component does not start to burn and also that no object in its environment catches fire. At the same time, by using a solder wire about 1 mm thick, current surges of some 8000 A (impulse form 8/20 μs) can be withstood. This means that with the overheating fuse, no costs need to be taken into account for a current bypass.

To modify the electric characteristics of the varistor, it is also possible to use two different varistor materials 1 and 30, for example, based on SiC.

The embodiment with the two ceramic base bodies also has the additional advantage that a spatial separation of the electrical contacts 5 and 15 from the electrically conducting piece 10 is possible. The electrically conducting piece is located in the intermediate space 35 between the two varistor base bodies, whereas the electrical contacts contact the sides 1A, 30A, facing away from the intermediate space in each case. Thereby, good thermal screening of the electrically conducting piece from the electric contacts is provided so that a high resistance to heat from the solder is provided. By this arrangement, in contrast to many traditional temperature fuses, problem-free soldering or welding of the electric contacts is possible without triggering the temperature fuse.

Figure 2A:
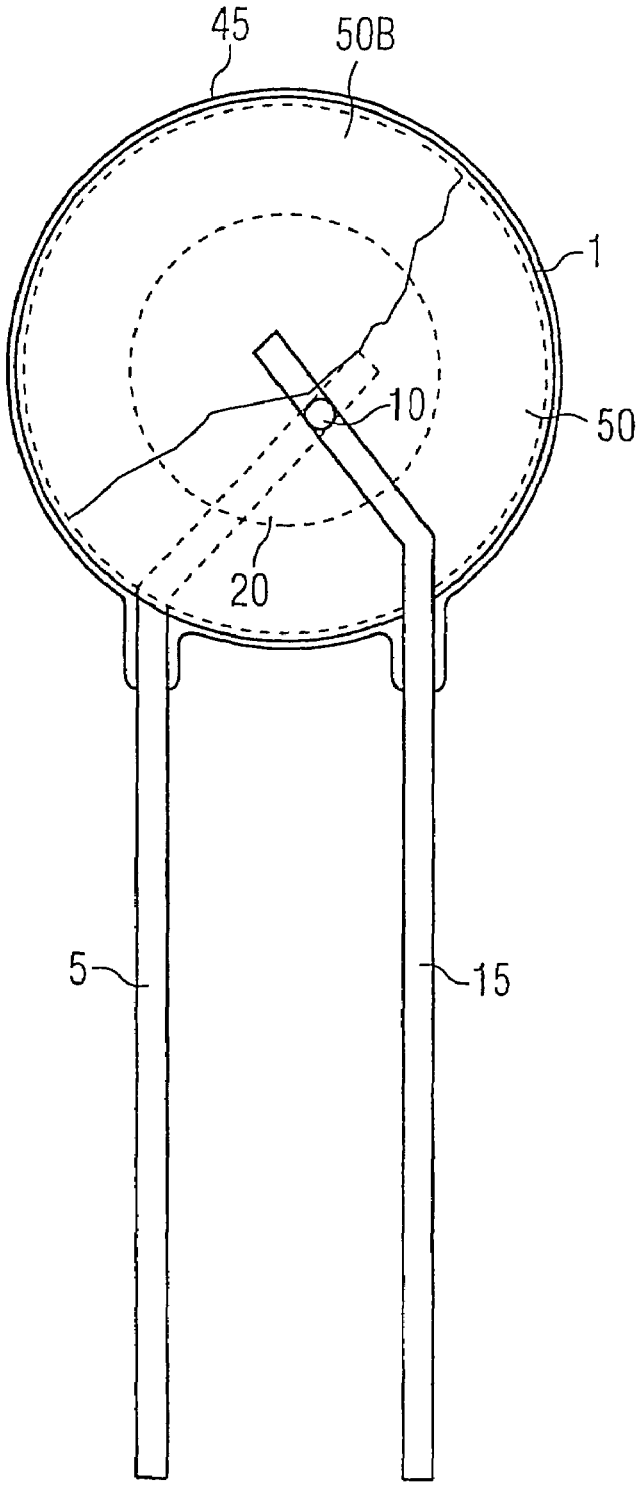
FIGS. 2A and 2B show a varistor with only one ceramic base body, in a top view and in cross-section.
Figure 2B:
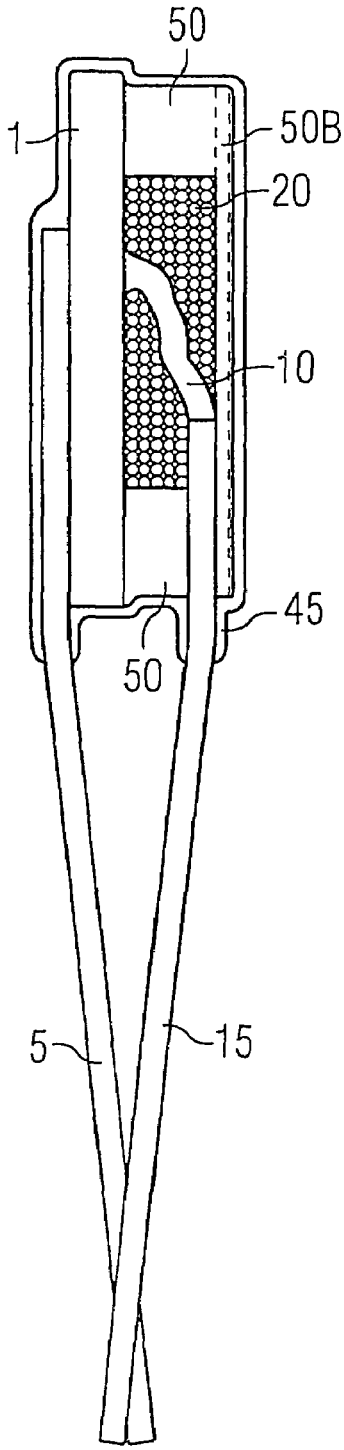

FIG. 2A shows a top view of, and FIG. 2B a cross-section through, a varistor with only one varistor base body 1. In this case, the electrically conducting piece 10 is in direct electric contact with the second electric contact 15 and the varistor base body 1. A ring 50, made of plastic, creates a hollow space to receive the electrically insulating material 20, which, in this embodiment, is to prevent an electric flashover between the varistor base body 1 and the second electric contact 15. The whole arrangement can be provided with a cover 50B that closes the component. In addition, the varistor base body 1 is contacted by the first electric contact 5.

This alternative embodiment shows similar characteristics in the case of overheating and similar current-diverting ability to that of the embodiment with two ceramic base bodies.

The electroceramic component is not limited to the examples that have been described herein. The electroceramic component may have many additional variations, especially in regard to the number of ceramic base bodies used, their arrangement with respect to each other, and the type of ceramic materials used.

What is claimed is:

1. An electric component comprising:

a first base body, which is comprised of ceramic;

a first contact that is on, and that connects to, the first base body;

a second base body, which is comprised of ceramic;

a second contact that is on, and that connects to, the second base body;

an electrically conducting element positioned along a current path between the first contact and the second contact, the electrically conducting element existing during normal operation of the electric component, and the electrically conducting element being meltable due to heating of at least part of the electric component when an operating voltage of the electric component is exceeded; and an electrically insulating material substantially surrounding the electrically conducting element and arranged so as to prevent an electric flashover between regions of the current path that are bridged by the electrically conducting element;

wherein the electrically insulating material is between the first and second base bodies when the electrically conducting element exists during normal operation.

2. The electric component of claim 1, wherein the electrically conducting element is thermally screened from the first and second contacts.

3. The electric component of claim 1, wherein:

the first and second base bodies are bundled;

the electrically conducting element is in a space between the first and second base bodies; and the first and second contacts contact the first and second base bodies, respectively, on sides of the first and second base bodies that face away from the space.

4. The electric component of claim 1, further comprising an encapsulation that creates and encloses a hollow space for the electrically insulating material.

5. The electric component of claim 4, wherein the encapsulation is heat resistant.

6. The electric component of claim 4, further comprising a housing that surrounds the first and second base bodies, the electrically conducting element, the electrically insulating material, and the encapsulation, and that at least partially surrounds the first and second contacts.

7. The electric component of claim 1, wherein the first and second base bodies include a varistor ceramic.

8. The electric component of claim 7, wherein the varistor ceramic comprises ZnO.

9. The electric component of claim 1, wherein the electrically insulating material drizzles or flows at least under certain circumstances.

10. The electric component of claim 1, wherein the electrically insulating material comprises quartz sand or glass balls.

11. The electric component of claim 1, wherein the electrically conducting element comprises solder.

12. The electric component of claim 1, wherein the electrically conducting element comprises solder with a melting point between about 80° C. and 180° C.

* * * * *

UNITED STATES PATENT AND TRADEMARK OFFICE

CERTIFICATE OF CORRECTION

PATENT NO. : 7,728,709 B2
APPLICATION NO. : 10/485166
DATED : June 1, 2010
INVENTOR(S) : Hermann Gruenbichler and Martin Schwingenschuh It is certified that error appears in the above-identified patent and that said Letters Patent is hereby corrected as shown below:

Cover Page, item [57] Column 2, Line 2 of Abstract:
Delete "ally" and Insert --electrically--

Signed and Sealed this

Twenty-first Day of September, 2010

David J. Kappos

David J. Kappos
*Director of the United States Patent and Trademark Office*